US009517633B2

(12) United States Patent
Xia et al.

(10) Patent No.: US 9,517,633 B2
(45) Date of Patent: Dec. 13, 2016

(54) INK CARTRIDGE FOR INK JET PRINTER

(71) Applicant: ZHUHAI NINESTAR MANAGEMENT CO., LTD., Zhuhai (CN)

(72) Inventors: Jingzhang Xia, Zhuhai (CN); Hongsheng Guo, Zhuhai (CN)

(73) Assignee: ZHUHAI NINESTAR MANAGEMENT CO., LTD., Guangdong (CN)

( * ) Notice: Subject to any disclaimer, the term of this patent is extended or adjusted under 35 U.S.C. 154(b) by 0 days.

(21) Appl. No.: 15/048,833

(22) Filed: Feb. 19, 2016

(65) Prior Publication Data

US 2016/0167392 A1 Jun. 16, 2016

Related U.S. Application Data

(63) Continuation of application No. PCT/CN2013/089315, filed on Dec. 13, 2013.

(30) Foreign Application Priority Data

Nov. 15, 2013 (CN) ..... 2013 2 0725705 U

(51) Int. Cl.
*B41J 2/175* (2006.01)

(52) U.S. Cl.
CPC ..... *B41J 2/17566* (2013.01); *B41J 2/1752* (2013.01); *B41J 2/17543* (2013.01);
(Continued)

(58) Field of Classification Search
CPC ..... B41J 2/1752
See application file for complete search history.

(56) References Cited

U.S. PATENT DOCUMENTS

2006/0170742 A1* 8/2006 Inoue ..... B41J 2/17553 347/86
2009/0135236 A1* 5/2009 Shimoda ..... B41J 2/17546 347/86

(Continued)

FOREIGN PATENT DOCUMENTS

CN 101462410 A 6/2009
CN 201721129 U 1/2011

(Continued)

OTHER PUBLICATIONS

International Search Report of corresponding International PCT Application No. PCT/CN2013/089315, dated Jul. 23, 2014.

*Primary Examiner* — Shelby Fidler
(74) *Attorney, Agent, or Firm* — J.C. Patents

(57) ABSTRACT

Disclosed is an ink cartridge (1) for an ink jet printer, which is detachably mounted to a cartridge mounting part (100) of the ink jet printer, a convex part (104) is provided in the cartridge mounting part (100). The ink cartridge (1) includes an ink storage chamber (11); an ink supply port (14); a first detecting mechanism (21); a movable member (30); and a second detecting mechanism (40) that is linked with the movable member (30), and the second detecting mechanism (40) can move up and down reciprocatively in a direction perpendicular to a direction in which the ink cartridge (1) is mounted. Using this ink cartridge prevents the problem of inaccurate detection caused by using a lever to detect whether the ink cartridge has been mounted in place.

13 Claims, 12 Drawing Sheets

(52) U.S. Cl.
CPC ..... *B41J 2/17546* (2013.01); *B41J 2/17553* (2013.01); *B41J 2002/17573* (2013.01); *B41J 2002/17576* (2013.01)

(56) References Cited

U.S. PATENT DOCUMENTS

| | | | | |
|---|---|---|---|---|
| 2010/0265305 | A1* | 10/2010 | Qin | B41J 2/17566 347/86 |
| 2011/0001773 | A1* | 1/2011 | Bianco | B41J 2/17513 347/86 |
| 2013/0258008 | A1* | 10/2013 | Kanbe | B41J 2/17526 347/86 |

FOREIGN PATENT DOCUMENTS

| | | | |
|---|---|---|---|
| CN | 203110526 | U | 8/2013 |
| EP | 2 397 330 | A1 | 12/2011 |
| JP | 2009-241319 | A | 10/2009 |

* cited by examiner

INK CARTRIDGE FOR INK JET PRINTER

CROSS-REFERENCE TO RELATED APPLICATIONS

This application is a continuation of International Application No. PCT/CN2013/089315, filed on Dec. 13, 2013, which claims the priority benefit of China Patent Application No. 201320725705.0, filed on Nov. 15, 2013. The contents of the above identified applications are incorporated herein by reference in their entireties.

TECHNICAL FIELD

The present utility model relates to an ink cartridge for an ink jet printer.

BACKGROUND

In the prior art, optical sensing method has been widely applied as one of the methods for detecting whether an ink cartridge for an ink jet printer has been mounted in place.

In common detecting technique, an ink cartridge must include two detecting mechanisms, a first detecting mechanism and a second detecting mechanism, so as to ensure the ink cartridge can be recognized by an ink jet printer after being mounted to the ink jet printer. Such a detecting technique is achieved primarily through shielding, by the detecting mechanisms, the signal path of a sensor in the ink jet printer. For example, Chinese patent No. CN201020186335.4 discloses an ink cartridge for an ink jet printer, where the detecting mechanisms thereof are a first signal shielding part 2 and a movable lever member 6, the detection principle is that: during mounting of the ink cartridge, the movable lever member 6 firstly shields a signal from a second sensor of the ink jet printer; subsequently, the first signal shielding part 2 shields a signal from a first sensor of the ink jet printer; subsequently, as the ink cartridge continues to be mounted, the movable lever member 6 rotates in an direction opposite to the mounting direction, under a combined action of a resetting member 4 and a tension generating member 5, and deviates from a signal path of the second sensor, and thereby does not shield the signal from the second sensor any more. As such, the printer can judge that the ink cartridge has been mounted normally. However, there are many potential problems in the above technique for mounting and detecting the ink cartridge, for example, since the movable lever member is supported by an elastic sheet, and after the ink cartridge are mounted repeatedly for many times, the movable lever member cannot return to the initial position due to deformation of the elastic sheet, which affects mounting and detecting of the ink cartridge in the next mounting and causes the ink cartridge to be unusable. Moreover, the movable lever member is susceptible to external influence, and thereby rotation thereof is affected, thereby causing failures of mounting and detecting and the use of the ink cartridge.

SUMMARY

The present utility model provides an ink cartridge for an ink jet printer, so as to solve the technical problem that mounting and detecting of the ink cartridge are unstable due to the use of a lever in the existing ink jet printer.

In order to solve the above technical problem, a technical solution adopted in the present utility model is described as follows.

An ink cartridge for an ink jet printer, detachably mounted in a cartridge mounting part of the ink jet printer, the cartridge mounting part of the ink jet printer is provided with a convex part, wherein the ink cartridge includes:

an ink storage chamber for storing ink;

an ink supply port for supplying the ink from the inside of the ink storage chamber to the outside of the ink storage chamber via the ink supply port;

a first detecting mechanism for shielding or changing light emitted by a first sensor of the ink jet printer when the ink cartridge is mounted into the cartridge mounting part;

a movable member that is pushed and moved by the convex part of the ink jet printer in the process of mounting the ink cartridge into the cartridge mounting part of the ink jet printer; and a second detecting mechanism that is linked with the movable member and may selectively shield light emitted by a second sensor of the ink jet printer or change a path of light emitted by the second sensor;

wherein, the second detecting mechanism can move up and down reciprocatively in a direction perpendicular to a direction in which the ink cartridge is mounted.

When the ink cartridge is mounted to the ink jet printer, the second detecting mechanism moves up and down reciprocatively in height direction perpendicular to a direction in which the ink cartridge is mounted.

The movable member includes a push rod and an elastic member, a through hole is provided at a position corresponding to the convex part when the ink cartridge is mounted, and the movable member is located in the through hole.

The second detecting mechanism includes a movable body and an elastic element, a light attenuating part for shielding light or changing light path is formed on the movable body, and a light penetrating part for allowing the light to pass through is provided above the light attenuating part of the movable body.

A protrusion is formed at a lower end of the push rod, and a convex part that matches with the protrusion is formed at an upper end of the movable body.

Both the protrusion and the convex part are formed by intersection of two mutually inclined planes.

Both the protrusion and the convex part are a hemispheroid.

The light attenuating part is formed by two light reflecting members intersected at a certain inclined angle, and, for example, is made of a light reflecting film, a light reflecting paper or other light reflecting materials.

The ink cartridge further includes an ink cup that is provided below the second detecting mechanism and communicated with the ink storage chamber.

The ink cup is provided with a prism for changing light path on a side just facing the second detecting mechanism, and the prism comprises two inclined planes intersected at a certain inclined angle.

By adopting the above technical solution, since the second detecting mechanism can be pushed by the movable member to move up and down in height direction perpendicular to a direction in which the ink cartridge is inserted, thereby achieving a normal detection when the ink cartridge is mounted, and avoiding the problem of inaccurate detection caused by using a lever for detecting. Moreover, since the following fact that an ink cup is added, the ink cup is provided below the movable body and communicated with the ink storage chamber, a shielding part consisting of two inclined planes intersected at a certain inclined angle is provided at a lower end of the movable body, the two inclined planes of the shielding part are made of a light reflecting material, and the ink cup is provided with a prism for changing light path on a side of the ink cup just facing the second detecting mechanism, a residual amount of the ink can be detected.

DESCRIPTION OF EMBODIMENTS

In order to make objects, technical solutions, and advantages of the present utility model clearer, the technical solutions in the embodiments of the present utility model are hereinafter described clearly and completely with reference to the accompanying drawings of the present utility model.

First, the major structural features of the ink cartridge are described.

Figure 1:
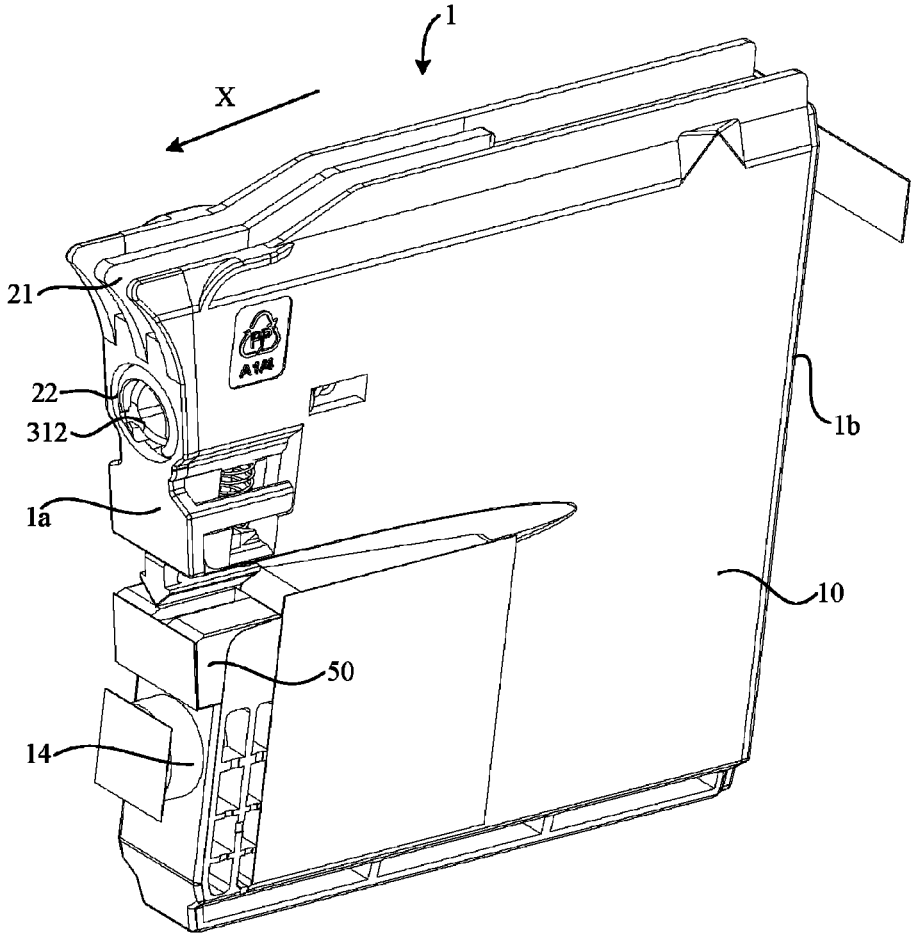
FIG. 1 is a perspective structural diagram of an ink cartridge in an upright condition according to the present utility model.
Figure 2:
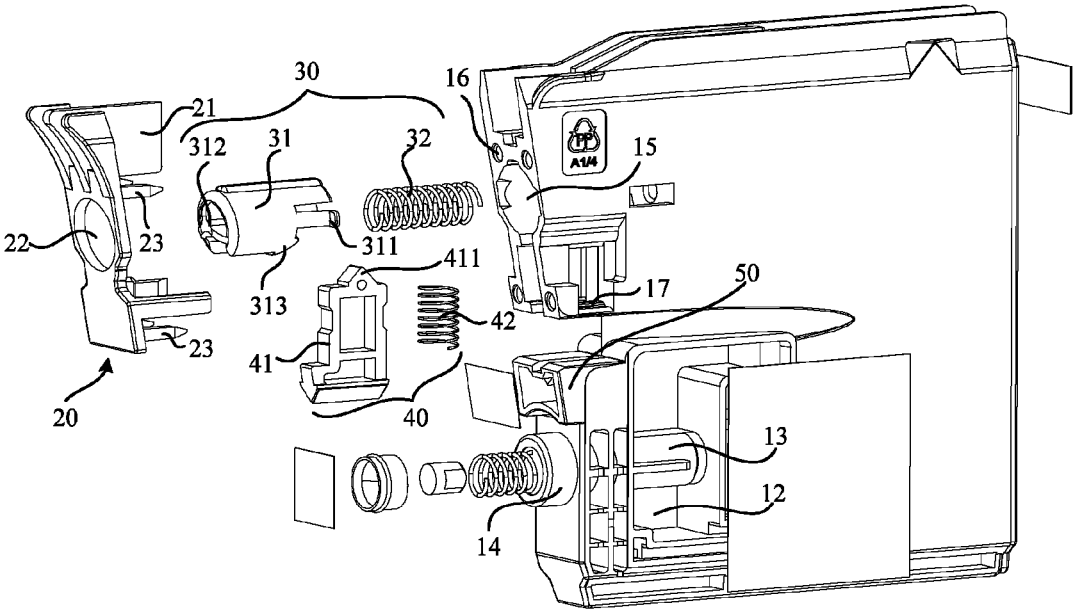
FIG. 2 is an exploded schematic structural diagram of an ink cartridge according to the present utility model.

FIG. 1 is a perspective structural diagram of an ink cartridge in an upright condition according to this embodiment, wherein the direction of arrow X is an inserting direction in which the ink cartridge is mounted to the ink jet printer, and orientation expressions related in this embodiment are all based on an ink cartridge in an upright condition, unless otherwise indicated. FIG. 2 is an exploded schematic structural diagram of the ink cartridge according to this embodiment. As clearly viewed from the two figures, the front side la of the ink cartridge 1 is configured to be oriented along the inserting direction X, and the rear side 1*b* is provides as a surface of the ink cartridge opposite to the front side 1*a*. The ink cartridge 1 includes a housing 10, the interior of which defines an ink storage chamber 11 for storing ink for printing operation and an ink supply chamber 12 for storing ink temporarily and being communicated with the ink storage chamber 11. An ink supply port 14 is provided at the lower part of the front side la of the ink cartridge, and is communicated with the ink supply chamber 12 via an ink supply pipe 13, an ink supply valve for controlling flow of ink is provided within the ink supply port 14, so as to control effective supply of ink. The ink supply valve in this embodiment consists of a spring, a valve core and a seal ring, and of course, valve bodies with other structures, such as a one-way water control valve and a self-sealing valve, are also possible.

As shown in FIG. 2, the ink cartridge 1 further includes a movable member 30. In this embodiment, the movable member 30 includes a push rod 31 and an elastic member 32, and the elastic member 32 in this embodiment is preferably a spring. The movable member 30 is inserted into a through hole 15 formed in a front wall of the ink cartridge body, and one end of the elastic member 32 abuts against one wall of the ink cartridge, and the other end thereof surrounds one end 311 of the push rod 31 near the through hole, and the other end 312 of the push rod 31 is exposed to the outside via the through hole 15. A protrusion 313 is formed at the lower end of the push rod 31, and the protrusion is formed by intersection of two mutually inclined planes 313*a*, 313*b*. Of course, the protrusion is not limited to two inclined planes, and also may be a curved surface, such as a hemispheroid.

As shown in FIG. 2, the ink cartridge 1 further includes a fixing member 20 for fixing the movable member 30 in the through hole 15 of the front wall of the ink cartridge body, and the fixing member 20 is formed with a first detecting mechanism 21, a through hole 22 and a fixing jaw 23. The fixing jaw 23 may be engaged with a locating hole 16 of the front wall of the ink cartridge body, so that the fixing member 20 may be fixed on the ink cartridge body to form a whole. The through hole 22 is formed in the fixing member 20 at a position corresponding to the through hole 15, and the through hole 22 has a diameter slightly smaller than the outer diameter of the other end 312 of the push rod 31, so as to avoid the movable member 30 to fall away from the through hole 15. The first detecting mechanism 21 is formed above the fixing member 20, and when the fixing member 20 is engaged with the ink cartridge body, the first detecting mechanism 21 is located on an upper surface of the ink cartridge at a position near the front side 1*a*. The first detecting mechanism 21 is made of materials which may shield a light signal or change a light signal path, such as lightproof materials, or light reflecting materials. Of course, the first detecting mechanism is not limited to the above of the fixing member, and also can be provided directly on the upper surface of the ink cartridge body.

As shown in FIG. 2, the ink cartridge 1 further includes a second detecting mechanism 40, which is provided in a space below the through hole 15 of the ink cartridge body, and can move up and down relative to the ink cartridge body under an external force, that is, the second detecting mechanism 40 can move in height direction perpendicular to a direction in which the ink cartridge is inserted. The second detecting mechanism 40 includes a movable body 41 and an elastic member 42. There is a top convex part 411 at an upper end of the movable body 41, and the top convex part is formed by intersection of two mutually inclined planes 411*a*, 411*b*. A light attenuating part for shielding light or changing a light signal path is formed at an lower end of the movable body 41, the light attenuating part in this embodiment is also formed by two inclined planes 412*a*, 412*b* intersected at a certain inclined angle, the two inclined planes 411*a*, 411*b* are made of special light reflecting materials that can change the light signal path, such as the light reflecting materials constituting the prism. A light penetrating part for allowing the light to pass through is provided above the light attenuating part of the movable body. The light penetrating part may be a gap, and also may be a transparent member for allowing the majority of light to pass through, and the light penetrating part in this embodiment is a gap located above the inclined planes 412*a*, 412*b*. The elastic member 42 is placed upright, with one end abutting against an upper part of the movable body 41, and the other end abutting against a guardrail 17 of the ink cartridge body, and in this embodiment, the elastic member is preferably a spring.

As shown in FIG. 2, the ink cartridge 1 further includes an ink cup 50 that is provided below the second detecting mechanism 40 and communicated with the ink storage chamber 11, and the ink cup 50 may store a certain amount of ink. The ink cup 50 is provided with a prism 51 for changing light path, on a side just facing the second detecting mechanism 40, and moreover, in this embodiment, the ink cup 50 has an opening on a side facing a direction in which the ink cartridge is inserted, and needs to be welded with a layer of sealing film prior to filling of ink.

Figure 3:
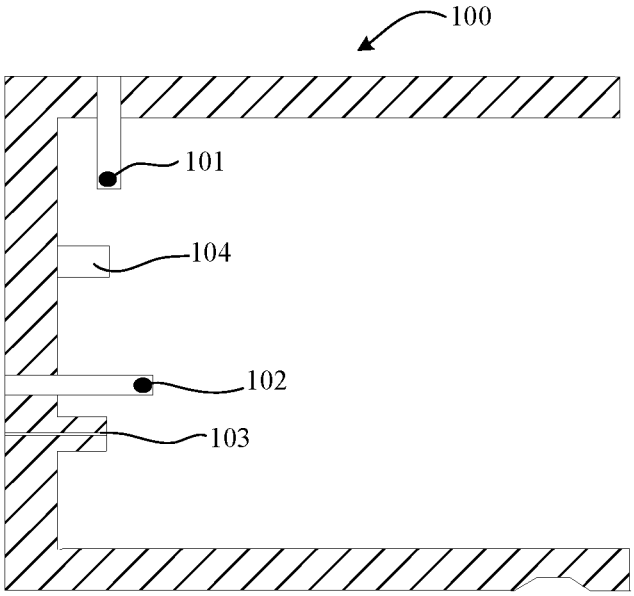
FIG. 3 is a schematic structural diagram of a cartridge mounting part of an ink jet printer according to the present utility model.

FIG. 3 is a schematic structural diagram of a cartridge mounting part of a printer. The cartridge mounting part 100 includes a first sensor 101, a second sensor 102, a printer ink supply port 103 and a convex part 104. The first sensor and the second sensor each include a signal transmitting part and a signal receiving part. In this embodiment, the first sensor 101 and the second sensor 102 are preferably optical sensors, and each include a light transmitting part and a light receiving part, and a light path is formed between the light transmitting part and the light receiving part. The printer ink supply port 103 is communicated with the ink supply port 14 of the ink cartridge, to deliver the ink within the ink cartridge to inside of the printer for printing operations. When the ink cartridge is mounted to the cartridge mounting part of the printer, the convex part 104 is opposite to the through hole 22 located at the front side la of the ink cartridge, and may be inserted into the through hole 22 to push the push rod 31.

Hereinafter, the mounting and detecting processes of the ink cartridge 1 will be described below.

Figure 4A:
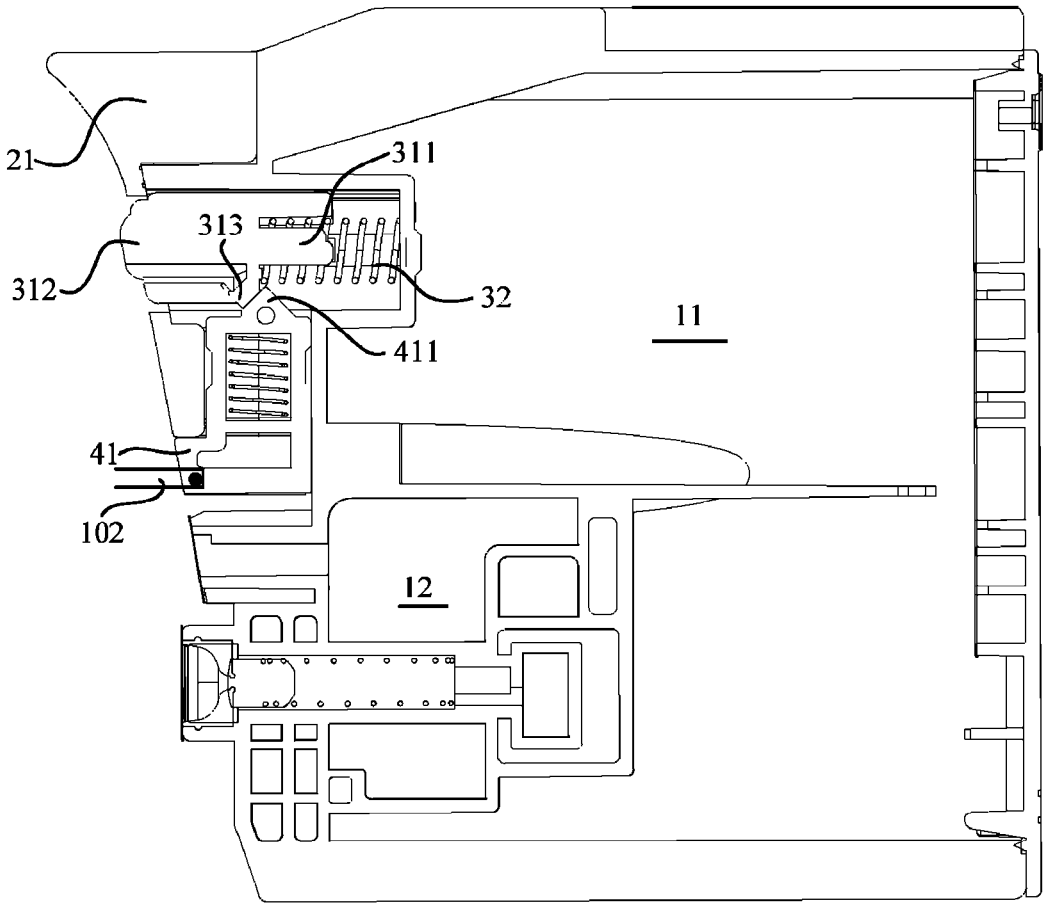
FIG. 4*a* and FIG. 4*b* are schematic diagrams of a first phase of an ink cartridge being mounted to a cartridge mounting part of a printer according to the present utility model.
Figure 4B:
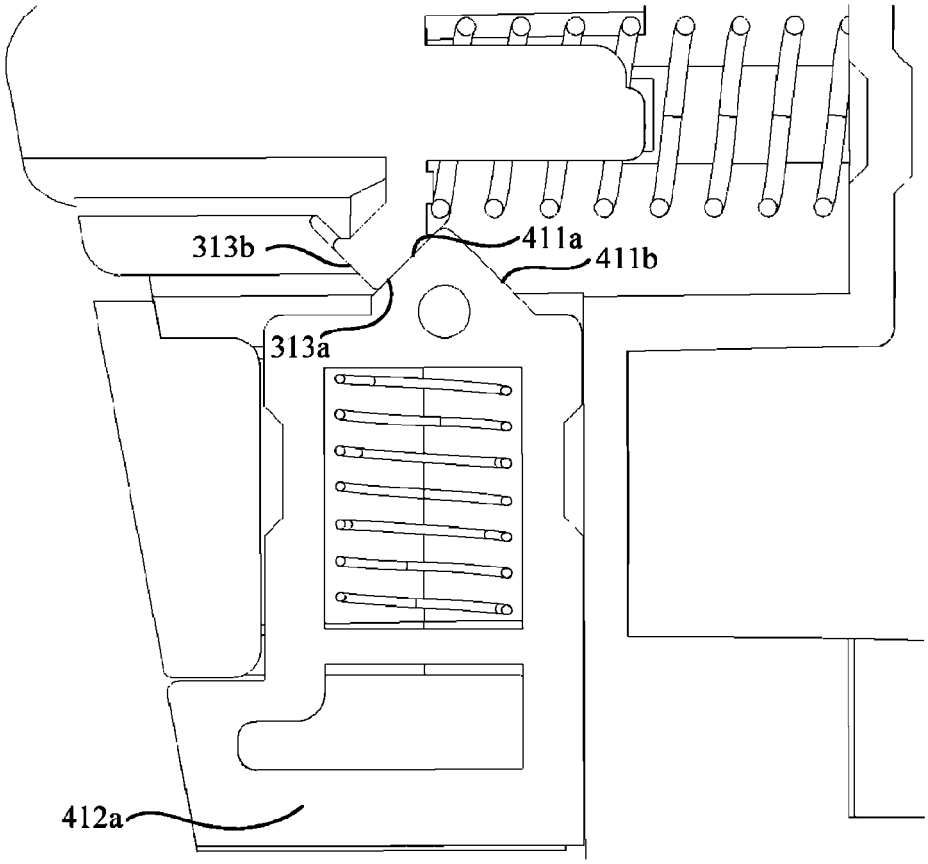
Figure 5A:
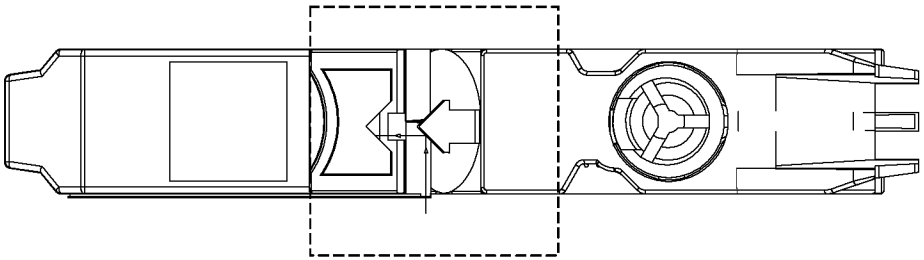
FIG. 5*a* and FIG. 5*b* are light path diagrams of a second sensor in a first phase of an ink cartridge being mounted according to the present utility model.
Figure 5B:
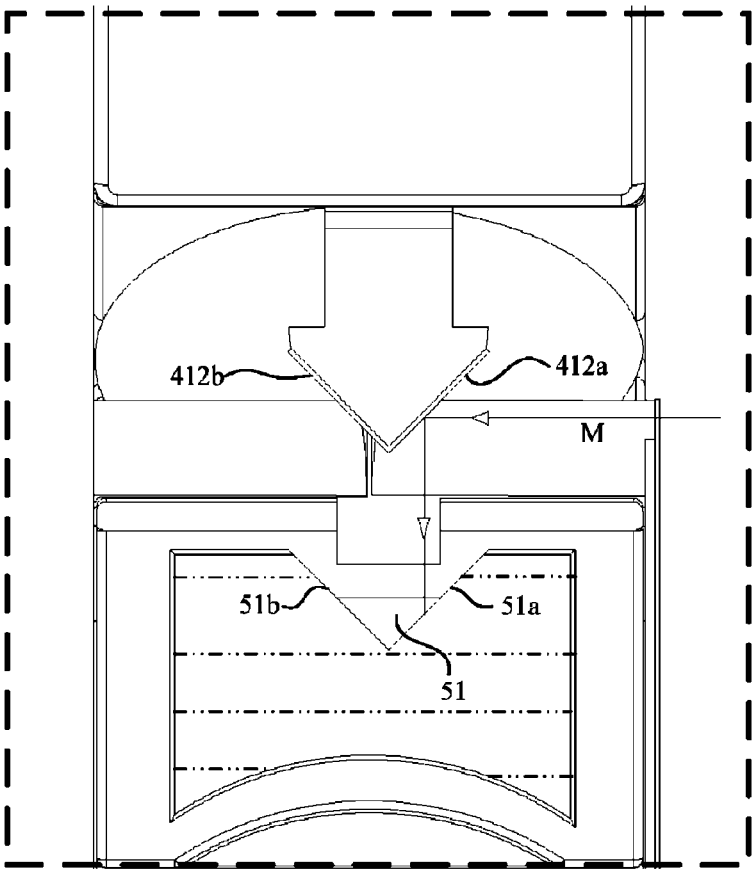
Figure 6A:
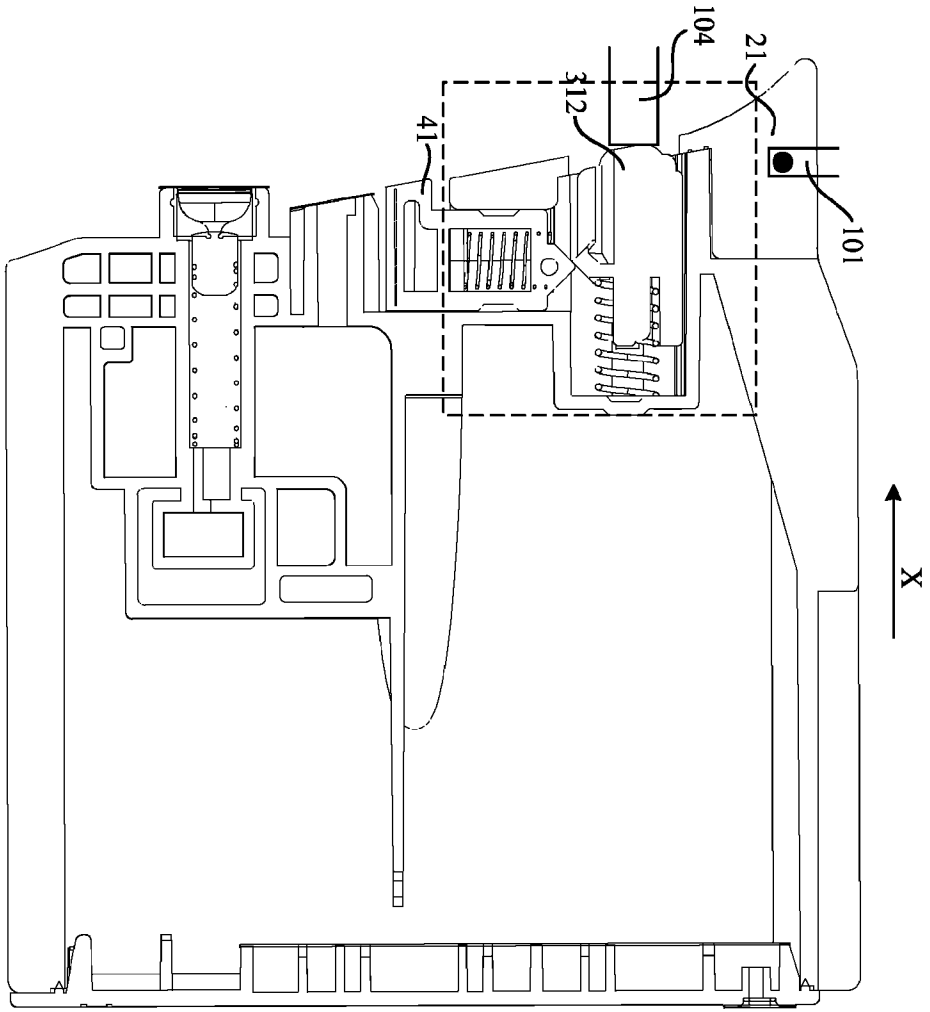
FIG. 6*a* and FIG. 6*b* are schematic diagrams of a second phase of an ink cartridge being mounted to a cartridge mounting part of a printer according to the present utility model.
Figure 6B:
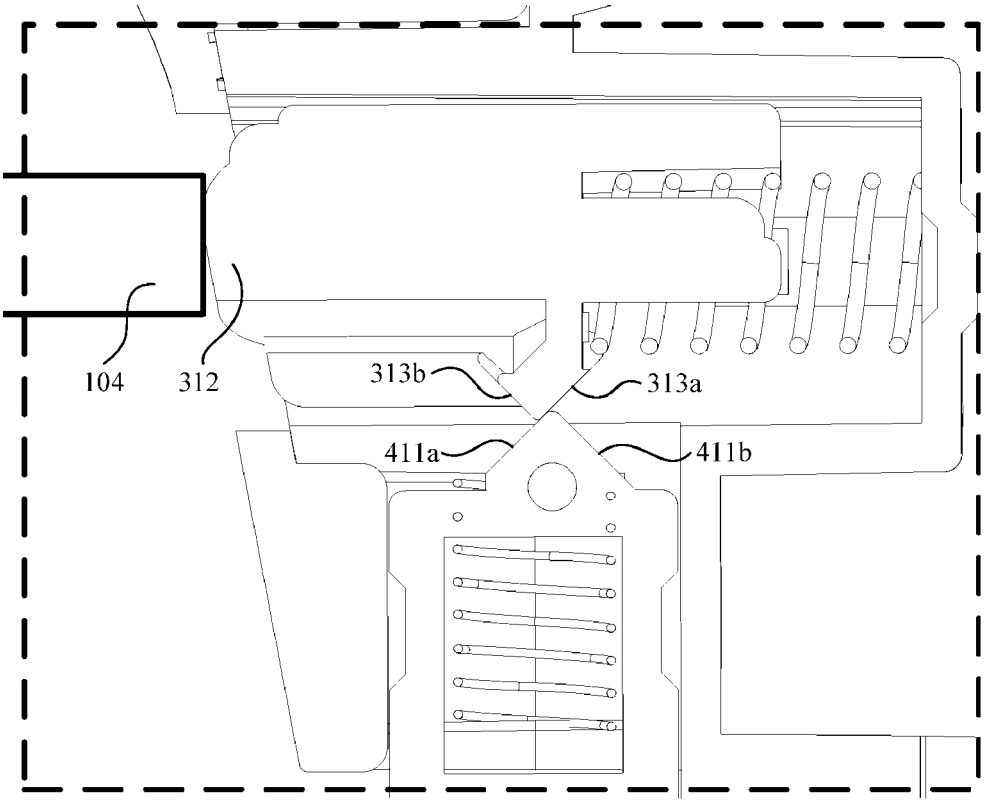
Figure 7:
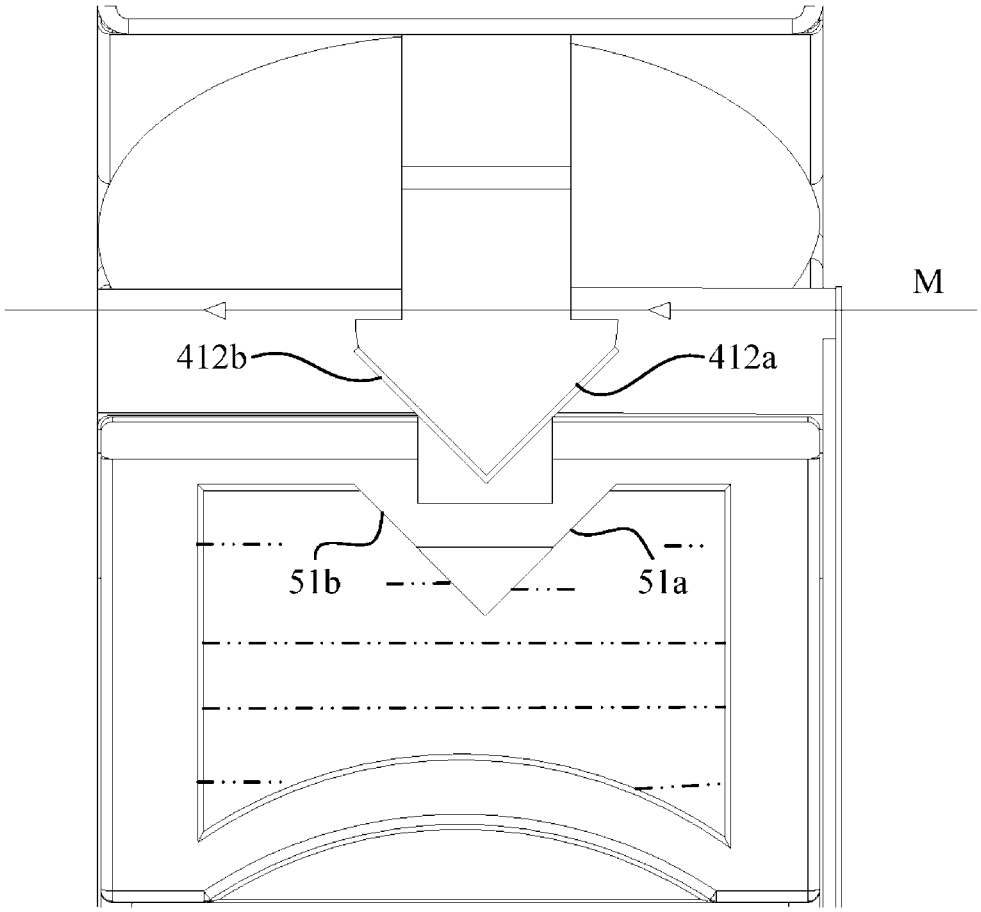
FIG. 7 is a light path diagram of a second phase of an ink cartridge being mounted according to the present utility model.

FIG. 4*a*, FIG. 4*b*, FIG. 6*a* and FIG. 6*b* are schematic diagrams of different phases that an ink cartridge is mounted to a cartridge mounting part of a printer. In order to illustrate change of states of various components of the ink cartridge during mounting more clearly, these four figures are all cross-sectional views of the ink cartridge. FIG. 4*a* and FIG. 4*b* are cross-sectional schematic diagrams of a first phase of an ink cartridge being mounted, FIG. 5*a* and FIG. 5*b* are light path diagrams of a second sensor in a first phase of an ink cartridge being mounted, and FIG. 5*b* is an enlarged view of the dotted box section in FIG. 5*a*. As shown in FIG. 4*a* and FIG. 4*b*, FIG. 4*b* is an enlarged view of the second detecting mechanism 40 shown in FIG. 4*a*. When the ink cartridge 1 is initially mounted, the light attenuating part of the second detecting mechanism 40, that is, two inclined planes 412*a*, 412*b* having a certain inclined angle, firstly enters the light path of the second sensor 102 of the cartridge mounting part, and since the inclined planes 412*a*, 412*b* are made of light reflecting materials, light emitted by the light transmitting part of the second sensor 102 is irradiated to the inclined plane 412*a* (or 412*b*) and is reflected, the light path is as shown by arrow M in FIG. 5*b* (the sealing film at the ink cup 50 is omitted), and light reflected by the inclined plane 412*a* (or 412*b*) is then irradiated to the prism 51 of the ink cup 50. Since the ink cartridge 1 is a brand-new ink cartridge, or an ink cartridge with a certain amount of ink still left in the ink storage chamber 11, the ink cup 50 is full of ink. At this time, light irradiated to a reflective plane 51*a* (or 51*b*) of the prism 51 is absorbed by the ink and cannot or seldom can be reflected, and thus, the light receiving part of the second sensor 102 cannot receive the light, and the second detecting mechanism 40 is detected by the second sensor 102. As the ink cartridge is mounted continuously, the first detecting mechanism 21 then enters the light path of the first sensor 101 of the cartridge mounting part, and thus shields light signal emitted by the light transmitting part of the first sensor 101 or changes path of the light signal emitted by the light transmitting part of the first sensor 101, so that the light receiving part cannot receive the light signal, and then the first detecting mechanism 21 is detected by the first sensor 101. As the ink cartridge is mounted continuously, as shown in FIG. 6*a* and FIG. 6*b*, where FIG. 6*b* is an enlarged view of the dotted box section in FIG. 6*a*, the convex part 104 of the cartridge mounting part is inserted into the through hole 22 located at the front side la of the ink cartridge, abuts against the other end 312 of the push rod 31, and pushes the push rod 31 in a direction opposite to mounting (inserting) direction of the ink cartridge, the elastic member 32 is gradually compressed. During the process of pushing the push rod 31 by the convex part 104, at first, the inclined plane 313*a* of the protrusion 313 abuts tightly against the inclined plane 411*a* of the top convex part 411 of the movable body 41, and then, the protrusion 313 located at the lower end of the push rod 31 gradually moves towards a direction opposite to the inserting direction of the ink cartridge, the inclined plane 313*a* of the push rod exerts a force on the inclined plane 411*a* of the movable body 41 in a direction perpendicular to a contact surface of the two inclined planes, so that the movable body 41 may move up and down in height direction against an elastic force of the elastic member 42 until the inclined plane 313*a* is about to cross the inclined plane 411*a*, and at this time, the height of the movable body 41 reaches the lowest, and the compression ratio of the elastic member 42 reaches the maximum, the light signal path at the moment is as shown in FIG. 7, light signal emitted by the light transmitting part of the second sensor 102 can pass through the gap located above the inclined planes 411*a*, 411*b* of the movable body 41 and reach the light receiving part of the second sensor 102, and therefore, the second sensor 102 can detect that the second detecting mechanism has moved out of the signal path of the second sensor.

Then, the mounting and detecting of the ink cartridge are completed. After the completion, the printer can judge that the ink cartridge 1 has been mounted normally and can continue to be used.

Figure 8:
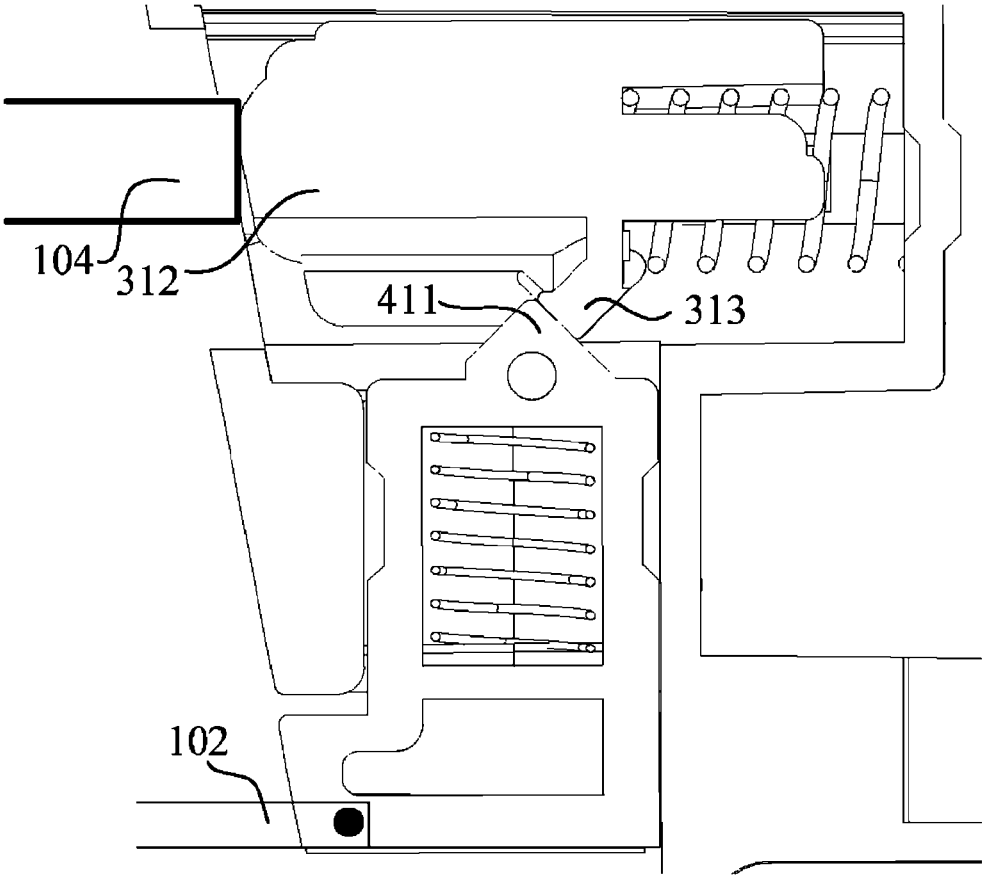
FIG. 8 is a partial schematic structural diagram of an ink cartridge after it is mounted according to the present utility model.

Moreover, in order to let the user know ink amount information in the ink cartridge timely, the ink cartridge 1 is further provided with a detecting mechanism for detecting the residual amount of ink. After the above mounting and detecting of the ink cartridge are completed, the ink cartridge needs to be continuously mounted by a certain distance, and then the inclined plane 313*a* crosses the inclined plane 411*a*, and thereby the inclined plane 313*b* abuts against the inclined plane 411*b*. As the push rod moves towards a direction opposite to the inserting direction of the ink cartridge, the pushing force of the inclined plane 313*b* on the inclined plane 411*b* is gradually reduced, and therefore, the movable body 41 gradually moves up in height direction under an elastic restoring force of the elastic member 42, and restores to the initial position, as shown in FIG. 8, the second detecting mechanism 40 enters the signal path of the second sensor 102 again, and shields or changes path of the light signal emitted by the light transmitting part of the second sensor 102 again, this principle has been described above, and is not repeated here.

Figure 9:
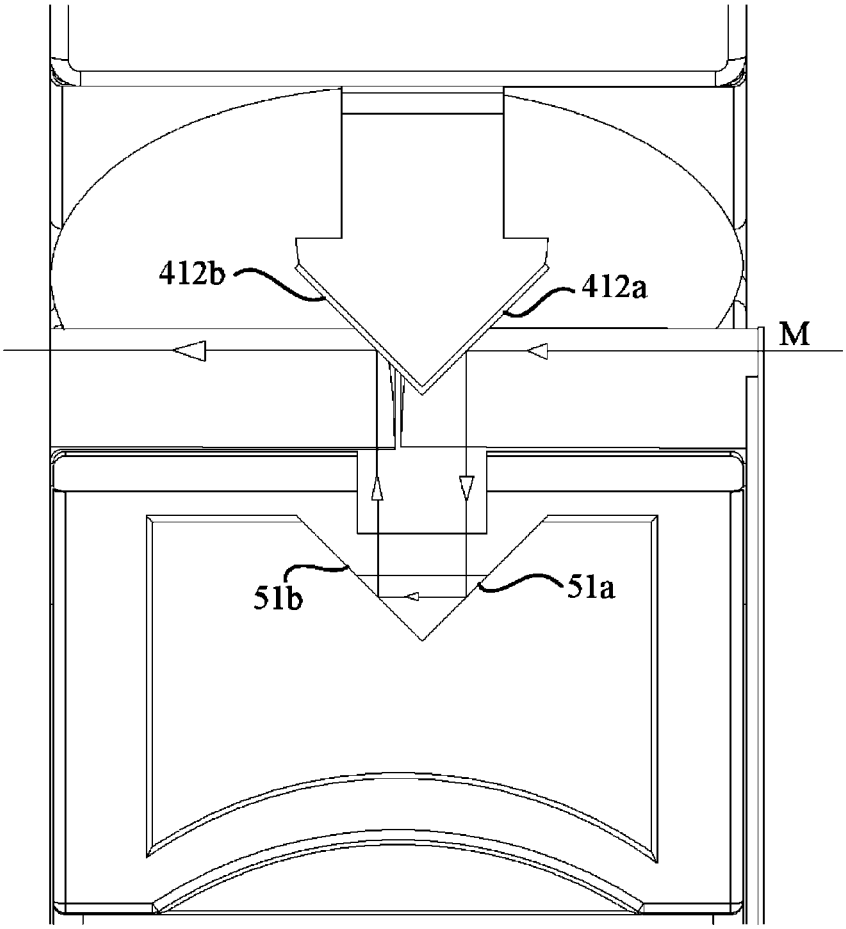
FIG. 9 is a light path diagram of a second sensor when ink in the ink cartridge is exhausted according to the present utility model.

After the ink cartridge in a mounted state has performed a certain amount of printing operations, ink in the ink storage chamber is gradually consumed, and the ink in the ink cup 50 is gradually reduced until fully consumed. As shown in FIG. 9, light emitted by the light transmitting part of the second sensor 102 is irradiated to the reflective plane 51*a* (or 51*b*) of the prism 51 after being reflected by the inclined plane 412*a*, and at this time, there is no ink in the ink cup 50, light is totally reflected on the reflective plane 51*a* (or 51*b*), light reflected by the reflective plane 51*b* (or 51*a*) is irradiated to the inclined plane 412*b* (or 412*a*), and then is reflected to the light receiving part of the second sensor 102, thereby the light receiving part that originally cannot receive light signal can receive the light signal, and therefore, the second sensor 102 can detect that the ink within the ink cartridge is about to be exhausted, and prompt the user with "!", and after a preset number of printings, the printer judges that the ink within the ink cartridge is completely exhausted and prompts the user to replace the ink cartridge.

When the ink cartridge is taken out of the cartridge mounting part, the convex part 104 in the cartridge mounting part cannot abut against the push rod 31 any more, and under an elastic restoring force of the elastic member 32, the push rod 31 is pushed to move towards inserting direction of the ink cartridge. Since the elastic restoring force of the elastic member 32 is greater than the elastic restoring force of the elastic member 42, the push rod 31 can push the movable body 41 to move up and down in height direction. After the inclined plane 313*b* crosses the inclined plane 411*b*, the movable body 41 restores to the initial position under the elastic restoring force of the elastic member 42, thereby achieving restoration of the ink cartridge.

As will be appreciated by persons skilled in the art, the embodiments described above are only preferred embodiments, and other alternatives are also possible. For example, when the residual amount of ink is detected in other manners (such as in a buoy manner), it is not necessary to use the ink cup for detecting, and the ink cup can be replaced with any other structures that cannot reflect light, in this way, the mounting and detecting functions of the ink cartridge also can be satisfied.

As another example, the inclined plane 412*a* and the inclined plane 412*b* in this embodiment can be an ordinary inclined plane adhered with light reflecting materials, such as a light reflecting paper and a light reflecting film, this also can achieve the purpose of changing light path.

Moreover, the inclined plane 412*a* (or 412*b*) can be made of a lightproof material. When light emitted by the light transmitting part of the second sensor 102 is irradiated to the inclined plane 412*a*, the light is shielded, the light receiving part of the sensor also cannot receive the light signal, and the purpose of detecting whether the ink cartridge has been normally mounted also can be achieved. Of course, in this case, the light shielding member of the second detecting mechanism 40 is not limited to an inclined plane, and can be any other member that can shield light.

As will be appreciated by persons skilled in the art, the embodiments described above are only part of the embodiments of the present utility model and not all of the embodiments. all other embodiments, which may be derived by persons skilled in the art from the embodiments given herein without creative efforts, shall fall within protection scope of the present utility model.

The invention claimed is:

1. An ink cartridge for an ink jet printer, detachably mounted to a cartridge mounting part of the ink jet printer, a convex part being provided in the cartridge mounting part of the ink jet printer, wherein the ink cartridge comprises:

an ink storage chamber for storing ink;

an ink supply port for supplying the ink from inside of the ink storage chamber to outside of the ink storage chamber via the ink supply port;

a first detecting mechanism for shielding light emitted by a first sensor of the ink jet printer or changing a path of light emitted by the first sensor when the ink cartridge is loaded into the cartridge mounting part;

a movable member that is pushed and moved by the convex part of the ink jet printer in the process of mounting the ink cartridge to the cartridge mounting part of the ink jet printer; and a second detecting mechanism that is linked with the movable member and can selectively shield light emitted by a second sensor of the ink jet printer or changing a path of light emitted by the second sensor;

wherein the first sensor and the second sensor are two separate sensors, and when the ink cartridge is mounted to the ink jet printer, the second detecting mechanism moves up and down reciprocatively in a height direction perpendicular to a direction in which the ink cartridge is mounted.

2. The ink cartridge for an ink jet printer according to claim 1, wherein, the movable member comprises a push rod and an elastic member, a through hole is provided at a position corresponding to the convex part when the ink cartridge is mounted, and the movable member is located in the through hole.

3. The ink cartridge for an ink jet printer according to claim 2, wherein, the second detecting mechanism comprises a movable body and an elastic element, a light attenuating part for shielding light or changing light path is formed on the movable body, and a light penetrating part for allowing the light to pass through is provided above the light attenuating part of the movable body.

4. The ink cartridge for an ink jet printer according to claim 3, wherein, a protrusion is formed at a lower end of the push rod, and a convex part that matches with the protrusion is formed at an upper end of the movable body.

5. The ink cartridge for an ink jet printer according to claim 4, wherein, both the protrusion and the convex part are formed by intersection of two mutually inclined planes.

6. The ink cartridge for an ink jet printer according to claim 4, wherein, both the protrusion and the convex part are a hemispheroid.

7. The ink cartridge for an ink jet printer according to claim 3, wherein, the light attenuating part is two light reflecting members intersected at an inclined angle, and, for example, is made of a light reflecting film, a light reflecting paper or other light reflecting materials.

8. The ink cartridge for an ink jet printer according to claim 7, further comprising an ink cup, which is provided below the second detecting mechanism and communicated with the ink storage chamber.

9. The ink cartridge for an ink jet printer according to claim 8, wherein, the ink cup is provided with a prism for changing light path on a side of the ink cup just facing the second detecting mechanism, and the prism comprises two inclined planes intersected at an inclined angle.

10. The ink cartridge for an ink jet printer according to claim 2, wherein one end of the elastic member abuts against one wall of the ink cartridge, and the other end thereof surrounds one end of the push rod near the through hole, and the other end of the push rod is exposed to the outside via the through hole.

11. The ink cartridge for an ink jet printer according to claim 2, wherein the ink cartridge further comprises a fixing member for fixing the movable member in the through hole.

12. The ink cartridge for an ink jet printer according to claim 2, wherein the second detecting mechanism is provided in a space below the through hole.

13. An ink cartridge for an ink jet printer, detachably mounted to a cartridge mounting part of the ink jet printer, a convex part being provided in the cartridge mounting part of the ink jet printer, wherein the ink cartridge comprises:

an ink storage chamber for storing ink;

an ink supply port for supplying the ink from inside of the ink storage chamber to outside of the ink storage chamber via the ink supply port;

a first detecting mechanism for shielding light emitted by a first sensor of the ink jet printer or changing a path of light emitted by the first sensor when the ink cartridge is loaded into the cartridge mounting part;

a movable member that is pushed and moved by the convex part of the ink jet printer in the process of mounting the ink cartridge to the cartridge mounting part of the ink jet printer; and a second detecting mechanism that is linked with the movable member and can selectively shield light emitted by a second sensor of the ink jet printer or changing a path of light emitted by the second sensor;

wherein, when the ink cartridge is mounted to the ink jet printer, the second detecting mechanism moves up and down reciprocatively in a height direction perpendicular to a direction in which the ink cartridge is mounted, and wherein, the movable member comprises a push rod and an elastic member, a through hole is provided at a position corresponding to the convex part when the ink cartridge is mounted, and the movable member is located in the through hole.

* * * * *